US005237938A

United States Patent [19]

Fujimori et al.

[11] Patent Number: 5,237,938

[45] Date of Patent: Aug. 24, 1993

[54] MOBILE TYPE MEDICAL REFUSE INCINERATING VEHICLE

[75] Inventors: Minoru Fujimori, 10-26, Kita-Sakurazua 2-chome, Toyonaka-shi, Osaka-fu; Toshiharu Yoshimura, Sendai, both of Japan

[73] Assignees: Rokuro Ito, Fukuoka; Minoru Fujimori, Osaka, both of Japan

[21] Appl. No.: 813,118

[22] Filed: Dec. 23, 1991

[51] Int. Cl.[5] ..... F23G 5/00

[52] U.S. Cl. ..... 110/240; 110/190; 110/241; 110/346

[58] Field of Search ..... 110/235, 240, 241, 190, 110/346

[56] References Cited

U.S. PATENT DOCUMENTS

| | | | |
|---|---|---|---|
| 3,595,181 | 7/1971 | Anderson . | |
| 4,627,365 | 12/1986 | Tseng | 110/240 |
| 4,827,855 | 5/1989 | Koptis et al. | 110/190 X |
| 4,852,815 | 8/1989 | Giannotti | 110/240 X |

FOREIGN PATENT DOCUMENTS

| | | |
|---|---|---|
| 2213456 | 8/1974 | France . |
| 2649782 | 1/1991 | France . |
| 84426 | 6/1980 | Japan . |
| 124831 | 8/1984 | Japan . |
| 151027 | 10/1989 | Japan . |
| 69220 | 5/1990 | Japan . |
| 2056656 | 3/1981 | United Kingdom . |
| 2070212 | 9/1981 | United Kingdom . |
| 2131154 | 6/1984 | United Kingdom . |

*Primary Examiner*—Edward G. Favors

*Attorney, Agent, or Firm*—Knobbe, Martens, Olson & Bear

[57] ABSTRACT

An incinerator is mounted on a vehicle which is adapted to carry thereon medical refuse, and a main burner in which oil or water is suitably injected is provided in a main furnace of this incinerator. Medical refuse discarded from medical facilities and suspected to cause secondary infection or direct infection is collected and is then at once disposed in the incinerator so as to be burnt.

13 Claims, 4 Drawing Sheets

MOBILE TYPE MEDICAL REFUSE INCINERATING VEHICLE

BACKGROUND OF THE INVENTION

The present invention relates to a mobile type medical refuse incinerating vehicle.

Some medical refuse discarded from medical facilities such as hospitals or the like is contaminated with several kinds of disease-causing germs such as viruses or the like, and possibly causes secondary infection which should be therefore prevented by suitably disposing the medical refuse. It goes without saying that the incineration of such medical refuse is a simple safe countermeasure.

Conventionally, most of such medical refuse is collected, for example, by refuse collecting vehicles which make the rounds of hospitals, and is then accumulated in a predetermined space there the medical refuse is charged into an incinerator for burning it.

However, the medical refuse includes various kinds of matters such as syringe barrels made of plastic, polyvinyl chloride or the like, syringe needles, dripping chemical bottles, tubes, incombustible cotton, and the like which are made of various kinds of materials. In particular, burning of polyvinyl chloride is very difficult since it emits, during combustion, a great deal of noxious gas which is the main culprit behind pollution.

Further, since certain kinds of medical refuse have a substance which is of a high burning calory or, conversely a low burning calory, if the various kinds of medical refuse were burnt together in a mixed condition, an incinerator would be overheated and be damaged, or the incomplete combustion would emit a large amount of unburnt gases.

Explanation will be made of this problem with reference to graphs A and B shown in FIG. 5.

In such a case that a certain kind of medical refuse is charged in an incinerator in order to incinerate it at a rate of 30 Kg/hour or 5 kg in every 10 minute, the temperature of burnt gas in the incinerator reaches about 1,200 deg. C within 3 to 5 minutes as shown by graph A, and accordingly, the incinerator is overheated.

Further, as shown by graph B, the quantity of gas generated by the combustion amounts to about 30 $m^3$ after about 4 minutes, and accordingly, the incineration of the medical refuse is not complete even though an after-burning furnace is provided. In this case, a great deal of gas would be emitted.

As mentioned above, conventional burn-up methods have offered disadvantages such that an incinerator would be overheated and damaged, and, it is difficult to sufficiently cope with abrupt changes in quantity of generated gas since changes in the completeness of combustion of the refuse is variable, and so forth.

SUMMARY OF THE INVENTION

The present invention is to provide a mobile type medical refuse incinerating vehicle adapted to go mainly to medical facilities such as hospitals, health centers or the like so as to collect medical refuse which is discarded therefrom and which is suspected to cause primary or secondary infection, and to burn up the collected medical refuse in an incinerator mounted on the vehicle after it is charged into the incinerator.

According to the present invention, an incinerator for medical refuse is mounted on a vehicle. The incinerator comprises a main burning furnace and an after-burning furnace communicating with each other. A main burner in which oil or water is injected interchangably, is provided in the main furnace. In this arrangement, an oil feed type rotary burner may be used as the above-mentioned main burner, having a three-way valve for selectively changing over the injection of air, oil and water.

Further, a drive cabin is provided on the above-mentioned carrier vehicle, and accordingly, the carrier vehicle can self-travel under the control of the driver.

Thus, since the incinerator is mounted on the medical refuse carrier vehicle, medical refuse which has been collected by the vehicle making the rounds of the medical facilities such as hospitals or the like, can be readily charged and burnt up in the incinerator, and accordingly, it is possible to reduce the steps of disposal thereof so as to remarkably decrease the risk of secondary infection while enhancing the working efficiency.

Further, lime water is used as the water to be injected from the above-mentioned main burner. Hydrogen chloride generated by the combustion of medical refuse is turned into calcium chloride by injecting this lime water into the main burning furnace, and thus it is possible to prevent emission of noxious gas. In this case, the lime water may be obtained by mixing hydrated lime or calcium hydroxide in water.

In this incinerator, ignition flame and secondary air are injected into the after-burning furnace from an after-burner, and accordingly, the ignition flame and the secondary air are forced to make contact with unburnt gas led from the main burning furnace so that the unburnt gas is perfectly burnt up, thereby it is possible to control the volume of generated gas at a constant value.

The after-burning furnace is connected thereto with a flue which is, in turn, connected to an exhaust pipe having an upper portion opened to the atmosphere. An ejector extending from an exhaust fan disposed below the exhaust pipe is inserted into the exhaust pipe in order to smoothly discharge the gas.

Further, various kinds of collected medical refuse are charged at a constant flow rate into the main burning furnace mounted on the carrier vehicle while oil is injected in a sprayed condition from the main burner in order to burn up the medical refuse.

If the temperature of the inside of the main burning furnace abruptly increases due to a thermal variation phenomenon caused by a high burning calory inherent in a particular medical refuse to be burnt, water is, for a while, injected in a sprayed condition from the main burner so as to regulate the temperature of the inside of the furnace in order to maintain a set temperature.

On the contrary, if the combustion temperature is low because the refuse burning calory is low, oil is injected from the main burner. Accordingly, the combustion temperature of the main burning furnace is increased so that the temperature of the furnace is controlled in a set temperature range in order to maintain the volume of generated gas at a constant value. Since the operation of the main burner is temperature varying thermocouples are arranged in the main burning furnace and the after-burning furnace in order to measure temperatures in the furnaces, respectively.

With this arrangement, it is possible to prevent the incinerator from being overheated, and to efficiently burn up medical refuse always at a constant combustion temperature with a constant volume of combustion gas while preventing occurrence of pollution.

Preferably, the incinerator incorporates an after-burning furnace, unburnt gas generated in the main burning furnace is completely burnt by ignition flame and secondary air from the after-burner, and the unburnt gas is substantially non-polluting by the time it is emitted into the atmosphere.

Further, a hearth carriage having on its upper surface a hearth is provided in the bottom section of the above-mentioned main burning furnace, which is adapted to travel on rails laid on the bottom section of the cargo bed so as to be pulled out of the main burning furnace, and accordingly, the disposal of incinerated ash can be facilitated.

DESCRIPTION OF THE PREFERRED EMBODIMENTS

Figure 1:
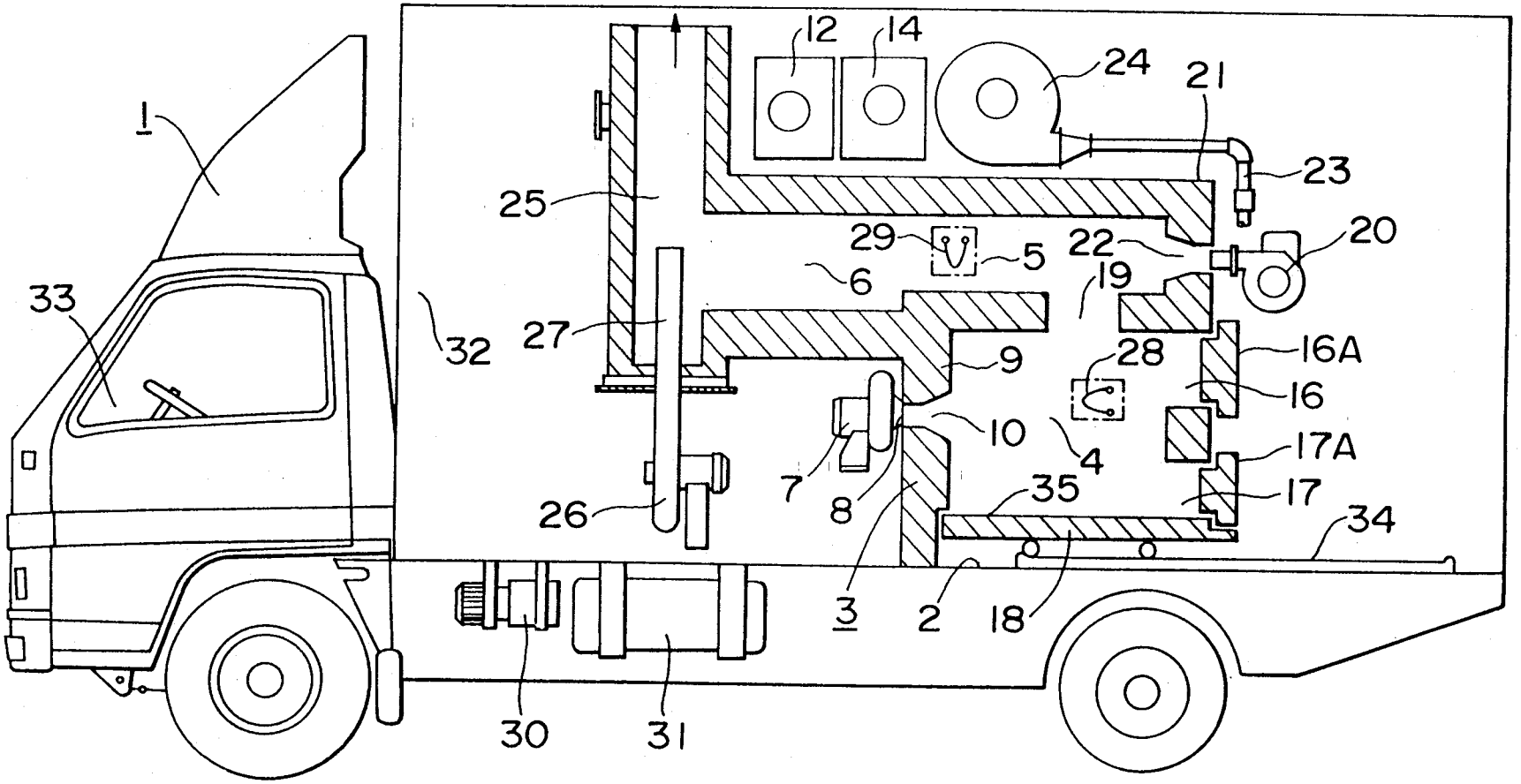
FIG. 1 is a schematic sectional view illustrating an incinerator on a refuse carrier vehicle according to the present invention.
Figure 2:
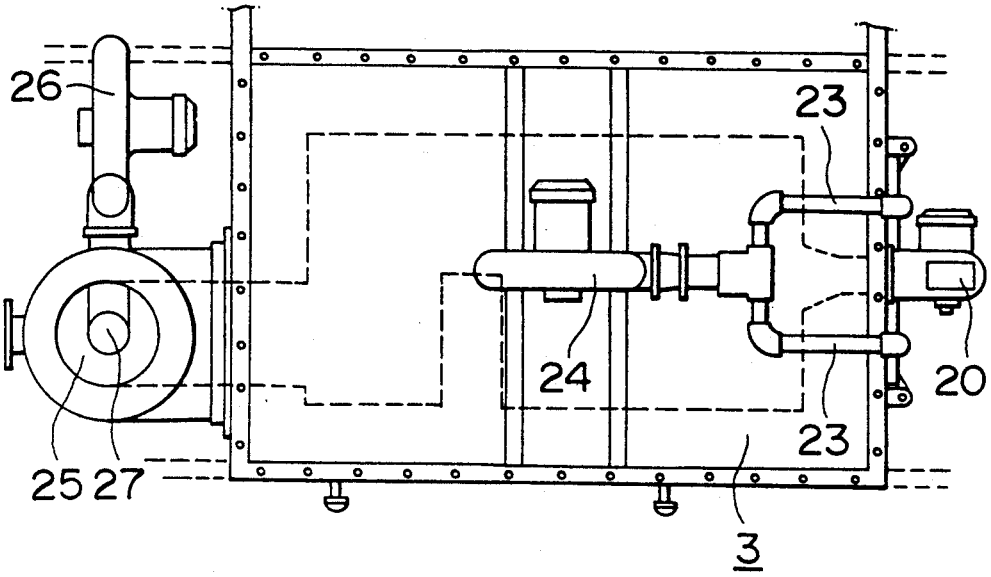
FIG. 2 is a plan view illustrating the incinerator shown in FIG. 1.
Figure 3:
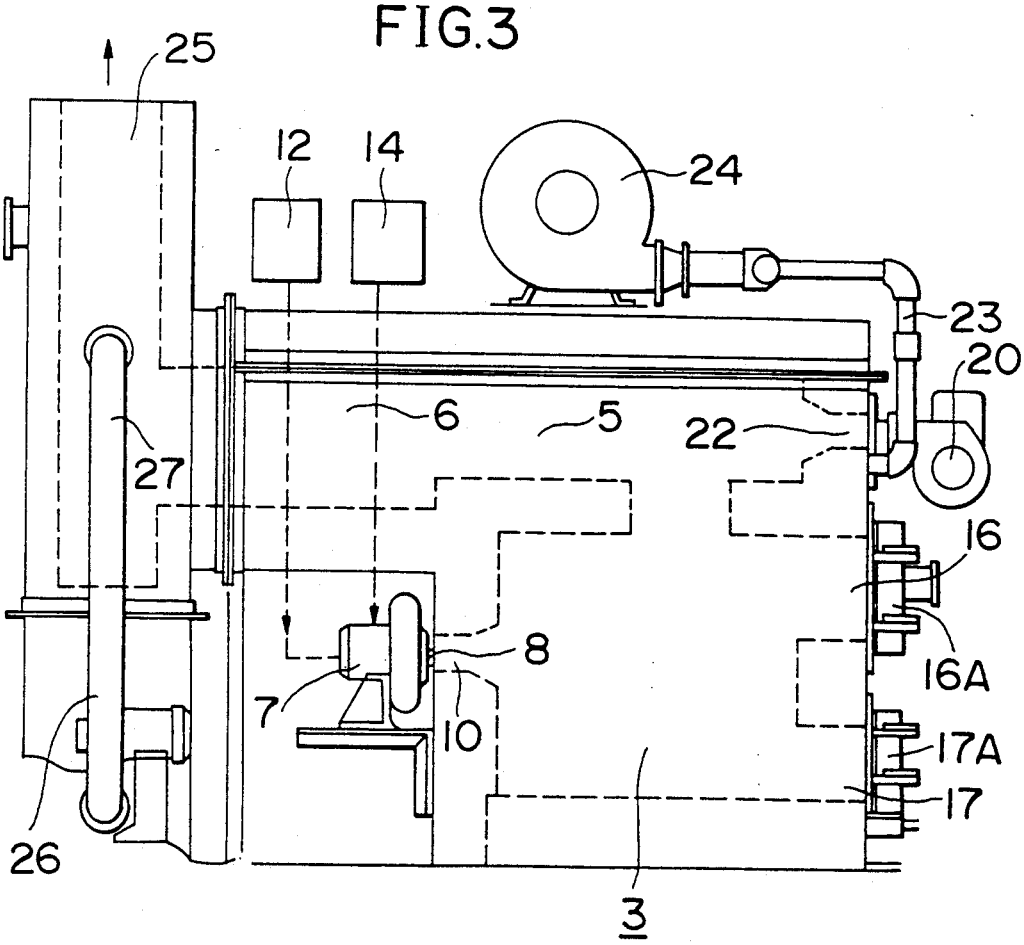
FIG. 3 is a front view illustrating the incinerator shown in FIG. 1.
Figure 4:
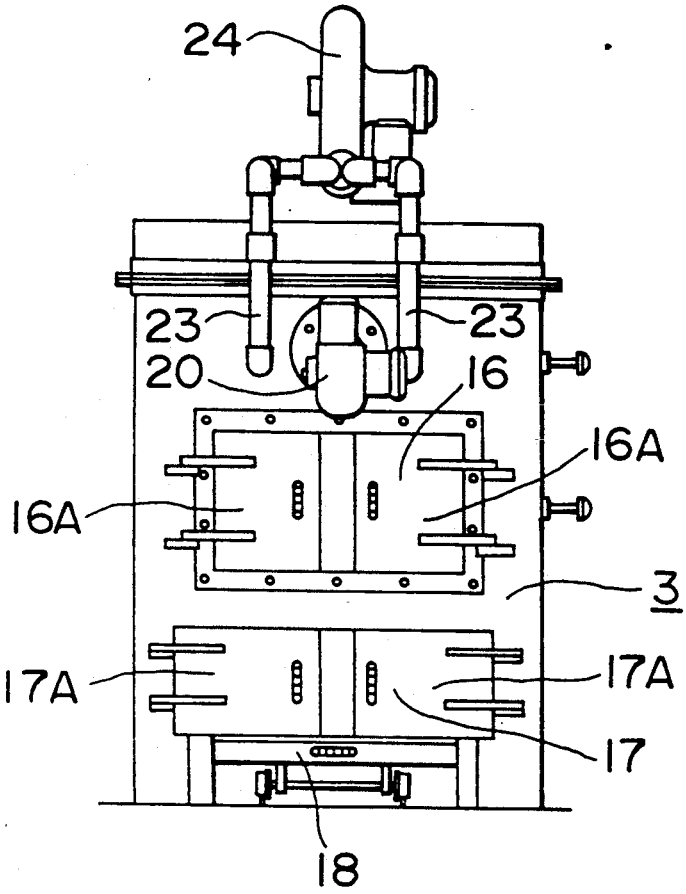
FIG. 4 is a right side view illustrating the incinerator shown in FIG. 1.

A medical refuse incinerating vehicle 1 comprises a drive cabin 33 in the front section thereof, and accordingly, can self-travel under the control of the driver. The vehicle 1 includes in its rear section a rear cargo bed 2 on which an incinerator 3 is mounted. The incinerator 3 incorporates a main burning furnace 4, an after-burning furnace 5 and a flue 6. The after-burning furnace 5 is located above the main burning furnace 4, and the flue 6 is connected to the after-burning furnace 5.

Figure 6:
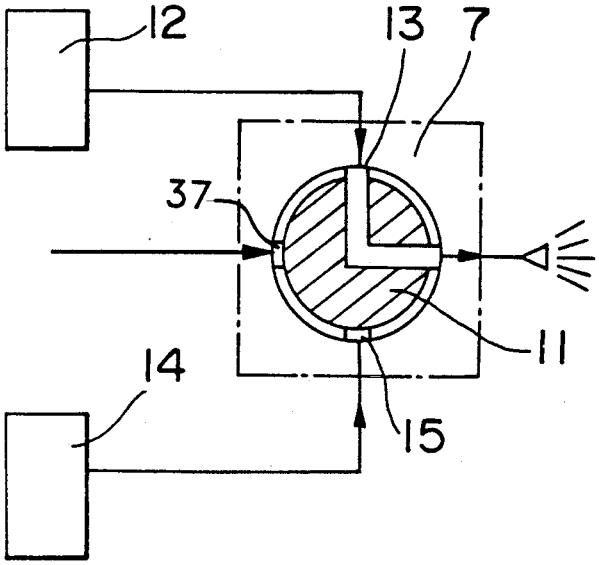
FIG. 6 is a principal explanatory view illustrating a three-way valve in a main burner.

The main burning furnace 4 is disposed in the lower section of the incinerator 3, and a main burner 7 is attached to the outer surface of one side wall of the main burning furnace 4. An injection nozzle 8 in the main burner 7 is disposed in an injection through-hole 10 formed in the wall member 9 of the main burning furnace 4. Further, this main burner 7 is an oil feed type rotary burner having a three-way valve 11 for selectively injecting air, oil and water, (refer to FIG. 6).

An oil tank 12 is disposed above the above-mentioned incinerator 3, and accordingly, with the use of the oil head thereof, the fuel oil is fed into an oil feed port 13 of the above-mentioned three-way valve 11 in the main burner 7.

Adjacent to the oil tank 12, a water tank 14 is arranged. Since the water tank 14 is arranged above the incinerator 3, water can be fed into a water feed port 15 in the three-way valve 11 in the main burner 7 with the use of the water head of the water tank 14. Air is sucked into the main burner 7 through the three-way valve 11 via an air inlet 37. Furthermore, the main burner 7 can take in air from another port (not shown).

The above-mentioned three-way valve 11 is adapted to be changed over under remote manual control, but can be changed over automatically by an automatic control system added thereto.

A refuse charge port 16 is formed in the rear side wall of the main burning furnace 4, and is adapted to be opened and closed by double doors 16A. Instead of using the double doors, a vertical slidable door can be used for opening and closing the charge port 16.

An ash take-out port 17 is formed below the charge port 16, which communicates with the main burning furnace 4, and is adapted to be opened and closed by double doors 17A.

A hearth carriage 18 having, on its upper surface, a hearth is disposed in the bottom section of the main burning furnace 4. The hearth carriage 18 can travel on rails 34 laid on the bottom section of the cargo bed 2. Accordingly, after the completion of incineration, the ash take-out port 17 is opened so as to enable the hearth carriage 18 to be pulled out from the main burning furnace 4.

Further, a draw port 19 is formed in the boundary wall between the main burning furnace 4 and the after-burning furnace 5 thereabove so that the main burning furnace 4 and the after-burning furnace 5 are communicated with each other through the draw port 19.

An after-burner 20 is attached to the outer surface of the rear wall member 21 of the after-burning furnace 5. This after-burner 20 is disposed in an injection through-hole 22 formed in the wall member 21. Oil is injected from the after-burner 20.

Further, adjacent to the after-burner 20, an air-blowing nozzle 23 is arranged, which is connected thereto with a blowing fan 24. Further, ignition flame generated from burning oil, and secondary air fed from the air-blowing nozzle 23 are forced to make contact with unburnt gas led from the main burning furnace 4 through the draw port 19. This contact causes perfect combustion of the unburnt gas.

Thus, if the burning calory inherent to the medical refuse which is burnt in the main burning furnace 4 is low so as to cause occurrence of incomplete combustion which results in generation of unburnt gas, the after-burner 7 is used to completely burn up the unburnt gas in the after-burning furnace 5. Accordingly, the volume of exhaust gas is controlled before emitting the same into the atmosphere.

An exhaust pipe 25 having its upper part opened to the atmosphere is connected to the above-mentioned flue 6, being communicated therewith. An ejector 27 which extends from an exhaust fan 26 disposed below the exhaust pipe 25 is inserted into the exhaust pipe 25. This exhaust pipe 25 allows the burnt gas to be smoothly discharged from the furnace.

Thermocouples 28, 29 are disposed in the main burning furnace 4 and the after-burning furnace 5, respectively, so as to measure the temperatures of the insides of the main burning furnace 4 and the after-burning furnace 5.

A generator 30 and a fuel tank 31 for storing fuel to be fed into an engine for the carrier vehicle 1 are arranged underneath the floor of the rear cargo bed 2.

Further, a control board section 32 on which several control panels are laid is provided in the front section of the rear cargo bed 2.

The above-mentioned water tank 14 is filled merely therein with water. However, calcium hydroxide is sometimes charged therein so as to prepare lime water (a solution of calcium hydroxide, $Ca(OH)_2$). This lime water is injected into the main burning furnace 4 from the main burner 7. This injection causes hydrogen chloride generated by the combustion of the medical refuse to be turned into calcium chloride, and accordingly, it is possible to prevent noxious gas from being discharged into the atmosphere. The formula of this chemical reaction is given as follows:

$$Ca(OH)_2+2HCl \rightarrow CaCl_2+2H_2O$$

Although it has been explained in the above-mentioned embodiment that oil and water are selectively injected from the main burner 7 by changing over the three-way valve 11, the main burner 7 may be, of course, used exclusively for the oil while an additional injection nozzle (which is not shown) for exclusively injecting the water is provided. It is essential to selectively inject the oil and the water into the main burning furnace 4.

Explanation will be hereinbelow made of the operation of the above-mentioned embodiment.

In a preferred situation, collected refuse is burnt at a rate of, for example, 30 kg/hour, that is, 5 kg for every 10 minutes, the incinerator 3 is operated under a condition in which the incinerator 3 is prevented from being overheated, and the volume of generated gas is restrained within a predetermined range.

When the medical refuse is charged into the incinerator 3, the temperature of the main burning furnace 4 increases so as to produce burnt gas. Should the burning calory of the medical refuse be high, the incinerator would be overheated if the combustion is continued further.

Figure 5:
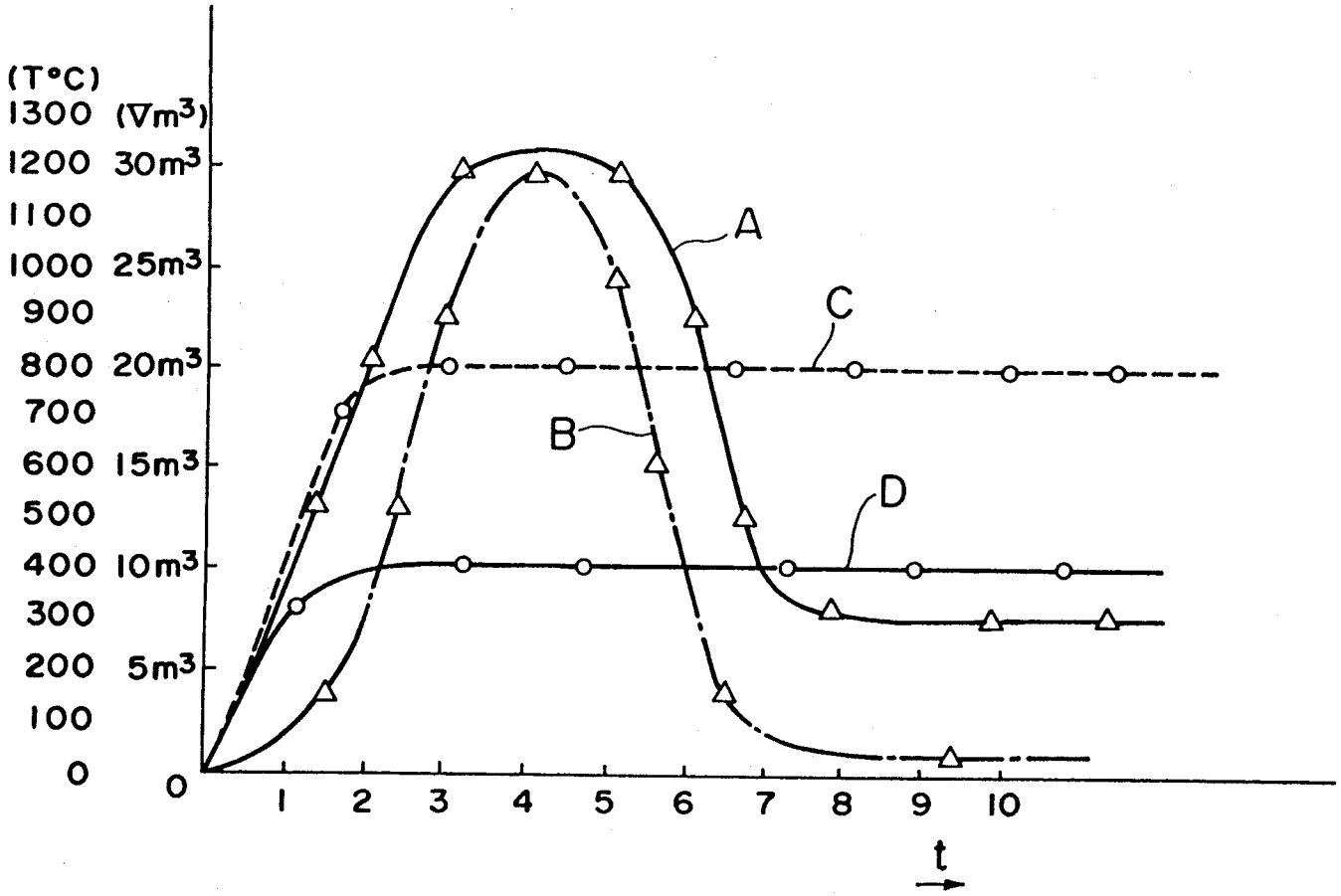
FIG. 5 is a characteristic graph showing a comparison between the prior art and the present invention.

Accordingly, it is necessary to monitor and control the combustion so as to prevent the main burning furnace 4 from being overheated, by measuring the temperature of the main burning furnace 4 with the use of the above-mentioned thermocouple 28 and changing over the three-way valve 11 for the main burner 7 so as to stop the injection of the oil or to inject the water in a sprayed condition, instead of the oil. Through these steps, the temperature of the main burning furnace 4 can be maintained to be constant, as shown by a graph C in FIG. 5. At this time, the volume of burnt gas caused by the combustion in the after-burning furnace 5 is controlled so as to be constant as shown by a graph D.

On the contrary, if the burning calory is low due to a high incombustibility inherent to medical refuse, the combustion becomes insufficient. In this case, the three-way valve 11 for the main burner 7 is changed over so as to inject oil in order to promote the combustion, and accordingly, the temperature of the main burning furnace 4 is adjusted to a high value. At this time, the volume of burnt gas is held to be constant, as shown by the graph D.

What we claim is:

1. A mobile type medical refuse incinerating vehicle characterized in that an incinerator for incinerating medical refuse is mounted on a medical refuse carrier vehicle, said incinerator comprising a main burning furnace and an after-burning furnace which are communicated with each other, further comprising means for selectively injecting oil or water into said main burning furnace.

2. A mobile type medical refuse incinerating vehicle as set forth in claim 1, wherein lime water is used as said water, and the lime water is stored in a tank and injected into said main burning furnace through said injecting means so as to turn hydrogen chloride which is produced by combustion of the medical refuse, into calcium chloride.

3. A mobile type medical refuse incinerating vehicle as set forth in claim 2, wherein calcium hydroxide is mixed into said water so as to prepare said lime water in said tank.

4. A mobile type medical refuse incinerating vehicle as set forth in claims 1 or 2, wherein said injecting is an oil feed type rotary burner, and has a three-way valve for selectively changing over the injection of air, the oil and the water.

5. A mobile type medical refuse incinerating vehicle as set forth in claim 1, wherein ignition flame and secondary air are injected into an after-burner so that said ignition flame and said secondary air are forced to make contact with unburnt gas led from said main burning furnace, which is therefore burnt up.

6. A mobile type medical refuse incinerating vehicle as set forth in claim 1, wherein thermocouples are provided in said main burning furnace and said after-burning furnace so as to measure temperatures of the insides of said furnaces, respectively.

7. A mobile type medical refuse incinerating vehicle as set forth in claim 1, wherein said carrier vehicle self-travels under control of a driver in a drive cabin.

8. A mobile type medical refuse incinerating vehicle as set forth in claim 1, wherein a flue having an exhaust pipe, having its upper part opened to the atmosphere, is connected to said main burning furnace, and an ejector extending from an exhaust fan is inserted into said exhaust pipe.

9. A mobile type medical refuse incinerating vehicle as set forth in claim 1, wherein a hearth carriage having, on its upper surface, a hearth, is provided in the bottom section of said main burning furnace, said hearth carriage travels on rails laid on the bottom section of a cargo bed so that said hearth carriage can be pulled out from said main burning furnace.

10. A method for incinerating medical refuse in a portable type medical refuse incinerator device, comprising the steps of:

inserting medical refuse into the furnace of said incinerator;

initiating the incineration of said medical refuse;

measuring the temperature in said furnace; and adding water to said furnace if the temperature in said furnace is too high with respect to the desired maximum temperature, in order to maintain a substantially constant temperature in said furnace.

11. The method of claim 10, further comprising the step of adding oil to said furnace of the temperature therein to too low.

12. The method of claim 10, further comprising the step of adding a solution of calcium hydroxide and water into said furnace in order to reduce the amount of dangerous gases formed in said furnace.

13. The method of claim 10, further comprising the step of further combusting the gases emitted from said burner in an after burner.

* * * * *